US005208922A

United States Patent [19]

Machinaga et al.

[11] Patent Number: 5,208,922

[45] Date of Patent: May 11, 1993

[54] SANITARY DEVICE

[75] Inventors: Haruo Machinaga, Anjo; Shinji Kawai, Toyota; Osamu Matsubara, Anjo; Tetsuo Makino, Okazaki, all of Japan

[73] Assignee: Aisin Seiki Kabushiki Kaisha, Kariya, Japan

[21] Appl. No.: 766,261

[22] Filed: Sep. 27, 1991

[30] Foreign Application Priority Data

Sep. 29, 1990 [JP] Japan ..... 2-258857
Sep. 29, 1990 [JP] Japan ..... 2-258858

[51] Int. Cl.[5] ..... A61H 35/00; E03D 9/08; A47K 3/20

[52] U.S. Cl. ..... 4/448; 4/420.4

[58] Field of Search ..... 4/420.1, 420.2, 420.3, 4/420.4, 420.5, 443, 444, 445, 446, 447, 448

[56] References Cited

U.S. PATENT DOCUMENTS

| | | | |
|---|---|---|---|
| 1,935,201 | 11/1933 | Callejo | 4/448 |
| 3,430,267 | 3/1969 | Van Houten | 4/420.4 X |
| 4,123,807 | 11/1978 | Oguma et al. | 4/448 |
| 4,136,407 | 1/1979 | Maurer | 4/448 |
| 4,208,746 | 6/1980 | Minamoto et al. | 4/448 |
| 4,581,779 | 4/1986 | Matsui et al. | 4/448 X |
| 4,841,582 | 6/1989 | Matsui et al. | 4/448 X |
| 5,050,249 | 9/1991 | Takeda et al. | 4/448 X |

FOREIGN PATENT DOCUMENTS

| | | | |
|---|---|---|---|
| 0274929 | 11/1990 | Japan | 4/448 |
| 2172802 | 10/1986 | United Kingdom | 4/448 |

*Primary Examiner*—William A. Cuchlinski, Jr.
*Assistant Examiner*—John L. Beres
*Attorney, Agent, or Firm*—Oblon, Spivak, McClelland, Maier & Neustadt

[57] ABSTRACT

A sanitary device is comprised of a toilet bowl having therein an inner space and a rear portion, a casing mounted on the rear portion of the toilet bowl, an outer nozzle having at its front, intermediate and rear portions an opening, a tapered wall and an inlet, respectively, and secured to the casing in such a manner that the outer nozzle is oriented toward the inner space of the toilet bowl. A water supply device supplies an amount of water continuously to the inlet of the outer nozzle. An auxiliary valve is provided at a frontward portion of the tapered wall of the outer nozzle for interrupting the fluid communication between the atmosphere and the inside of the outer nozzle. An inner nozzle has holes top be aimed at a body part and disposed in the outer nozzle in such a manner that when the inner nozzle is in its retracted position, the fluid communication between the inlet and the inside of the outer nozzle is established, and when a retainer mounted of the rear portion of the inner nozzle is in engagement with the tapered wall, the extended position of the inner nozzle is established. A spring urges the inner nozzle in the direction of its retracted position and a valve is disposed in a rear portion of the inner nozzle so as to be opened only when the inner nozzle is in its retracted or extended position.

3 Claims, 5 Drawing Sheets

SANITARY DEVICE

BACKGROUND OF THE INVENTION

The present invention relates to a sanitary device, and in particular to a sanitary device having a nozzle for injecting water warmed up to a temperature toward a body part such as the anus of a user or a pubic portion of a female user.

In a conventional sanitary device in which an inner nozzle is set to be transferred to its extended position from its retracted position before an amount of water is injected from the inner nozzle, the inner nozzle is accommodated in an outer nozzle so as to be moved therealong. For bringing the inner nozzle into its extended position, the water is supplied to the outer nozzle. The water is also used for washing the body part after the inner nozzle is brought into its extended position.

Upon the interruption of the water supply to the outer nozzles upon completion of the washing of the body part, the remaining water in the outer and inner nozzles should be drained into the inner space of the toilet bowl. The reason is that cold water is discharged onto the body part at the beginning of next washing thereof unless the remaining water has drained. In light of this, some mechanisms have been proposed for preventing the discharge of cold water at an initial stage of the washing. However, no mechanism has been found which is simple in construction.

SUMMARY OF THE INVENTION

It is, therefore, a primary object of the present invention to provide a sanitary device which can comply with the foregoing requirements with a simple structure.

In order to attain the foregoing object, a sanitary device according to the present invention is comprised of a toilet bowl having therein an inner space and a rear portion, a casing mounted on the rear portion of the toilet bowl, an outer nozzle having at its front, intermediate and rear portions, an opening, a tapered wall and an inlet, respectively, and secured to the casing in such a manner that the outer nozzle is oriented toward the inner space of the toilet bowl, water supply device for supplying an amount of water continuously to the inlet of the outer nozzle, an auxiliary valve provided at a frontward portion of the tapered wall of the outer nozzle for interrupting the fluid communication between the atmosphere and the inside of the outer nozzle, an inner nozzle having holes to be aimed at a body part and disposed in the outer nozzle in such a manner that when the inner nozzle is in its retracted position, the fluid communication between the inlet and the inside of the outer nozzle is established, and when a retainer mounted to the rear portion of the inner nozzle is in engagement with the tapered wall, the extended of the inner nozzle is established, a spring for urging the inner nozzle in the direction of its retracted position and a valve disposed in a rear portion of the inner nozzle so as to be opened only when the inner nozzle is in its retracted or extended position.

BRIEF DESCRIPTION OF THE DRAWINGS

These and other objects, features and advantages of the present invention will become more apparent on reading the following detailed description with reference to the accompanying drawings, wherein like members bear like reference numerals, and wherein.

DETAILED DESCRIPTION OF THE PREFERRED EMBODIMENTS

Figure 1:
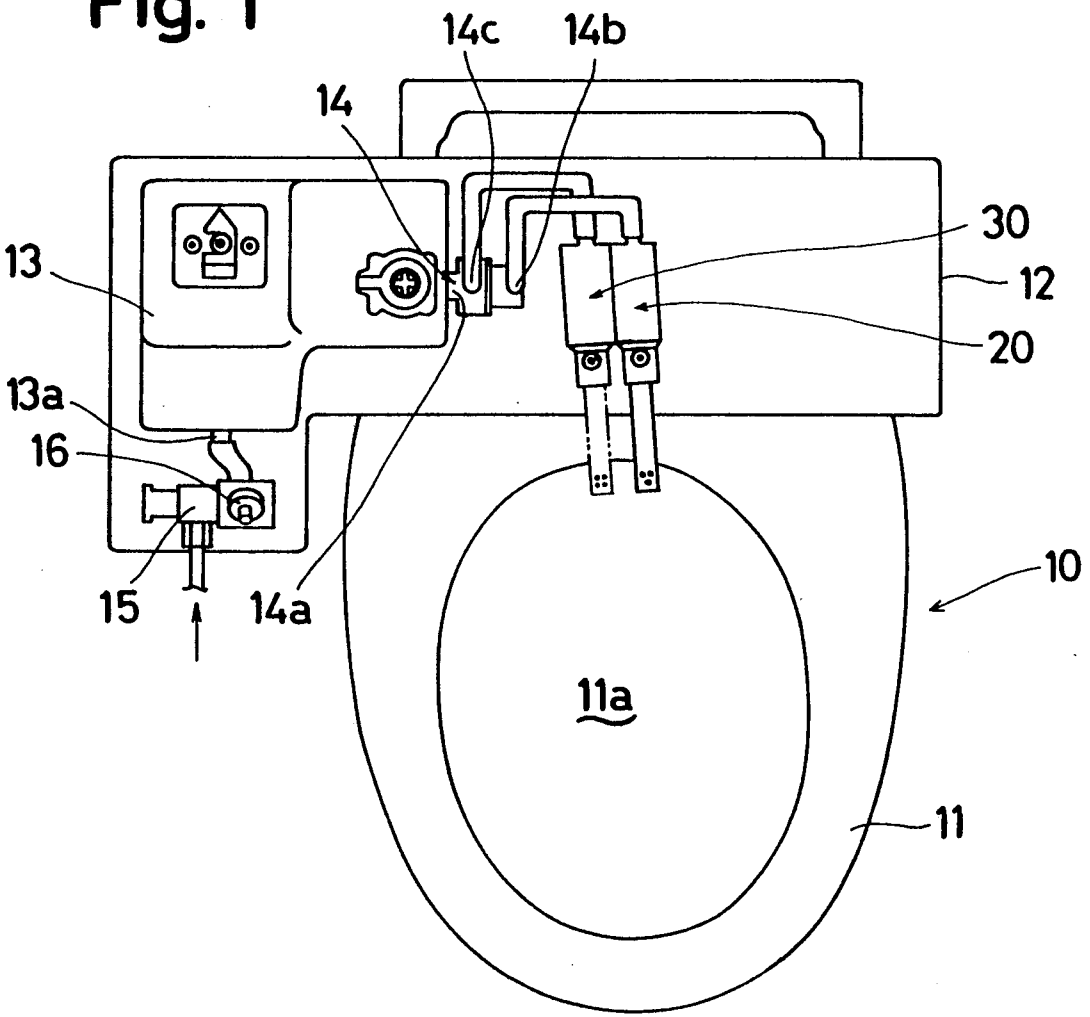
FIG. 1 is a plane view of a sanitary device according to an embodiment of the present invention.
Figure 2:
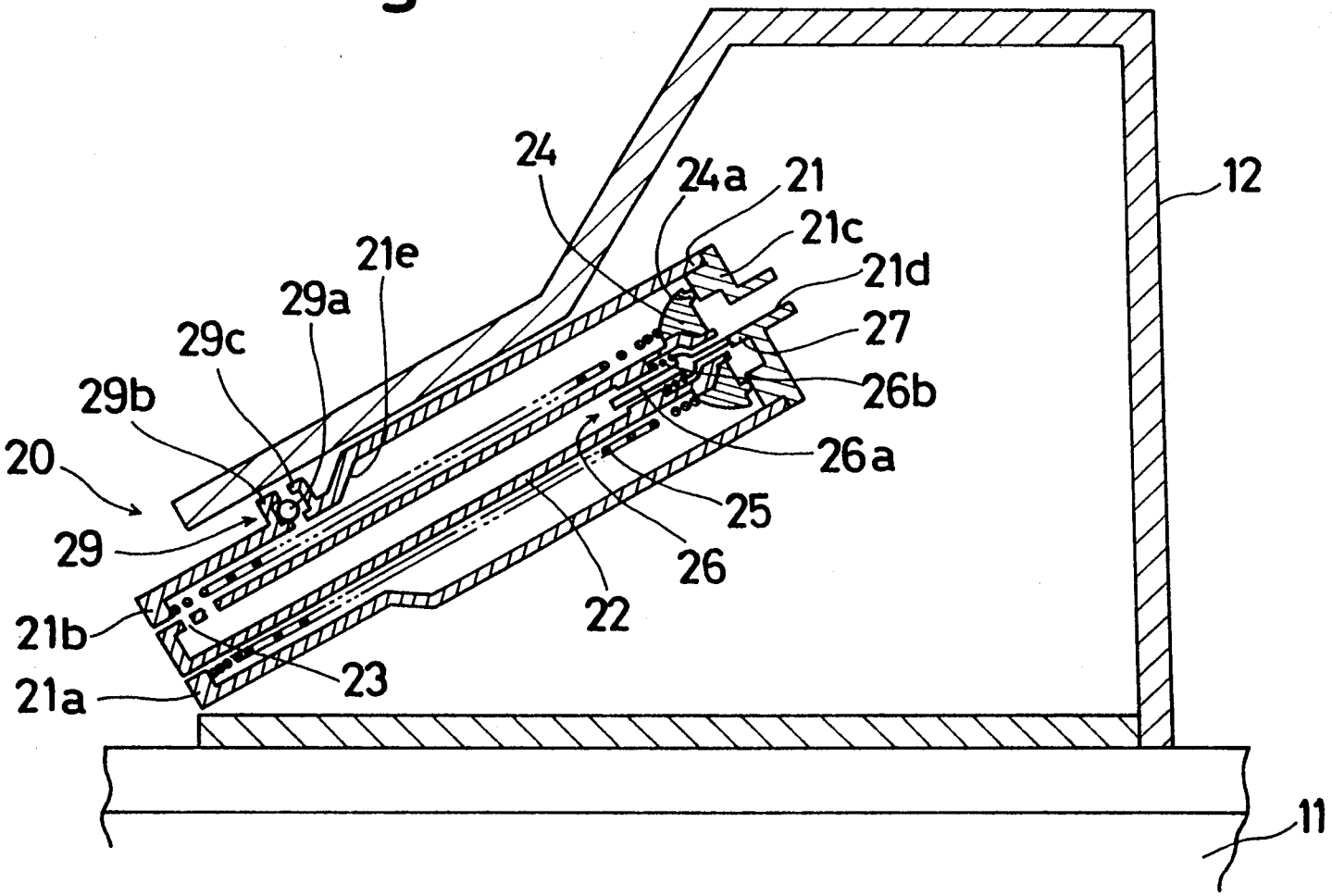
FIG. 2 is a cross-sectional view of a nozzle which is out of use, and a neighborhood thereof.
Figure 3:
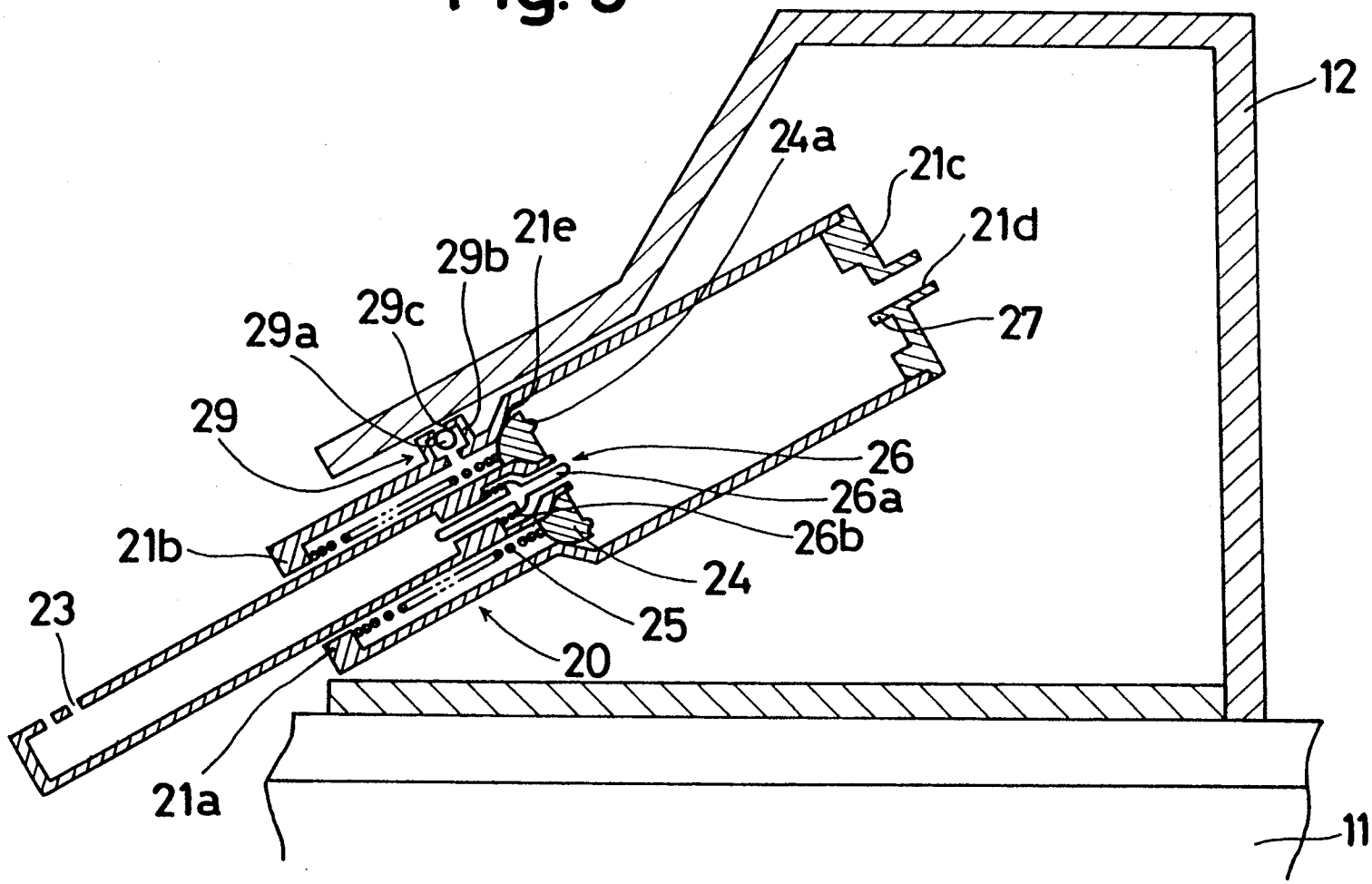
FIG. 3 is a cross-sectional view of a nozzle which is in use, and a neighborhood thereof.

Referring first to FIGS. 1 through 3, a sanitary device 10 includes a toilet bowl 11 and a seat (not shown) pivotably connected to a rear portion of the toilet bowl 11 to be up or down, as is well known. At the rear portion of the toilet bowl 11, there is mounted a casing 12 in which a first nozzle means 20 for washing the anus of a user and a second nozzle means 30 for washing the pubic portion of a female user are arranged in a side by side manner.

In the casing 12, there is provided a tank 13 in which an amount of water is stored. The water is warmed up to a temperature by a heater (not shown), under the control of a control means (not shown) as well known. An outlet (not shown) of the tank 12 is in fluid communication with an inlet **14*a* of a valve 14 having two outlets 14*b* and 14*c* both of which are in fluid communication with the first and the second nozzle means 20 and 30**, respectively.

An inlet **13*a* of the tank 13 is set to be supplied with an amount of water under pressure from a city water or waterworks via an electromagnetic valve 15 and a regulating valve 16. The water pressure from the inlet 13*a* of the tank 13 urges the water therein toward the valve 14. The resultant or pushed-out water is then fed to either nozzle means. It is noted that upon selection of the nozzle means the corresponding outlet of the valve 14 is brought into communication with its inlet 14*a*. In order to prevent the reverse flow of water from each nozzle means 20 or 30, a one-way valve (not shown) in the form of a vacuum breaker is interposed between the tank 13 and the valve 14**.

The first nozzle means 20 will be detailed hereinafter with reference to FIGS. 2 and 3. The detailed description of the second nozzle means 30 is omitted due to the fact that both nozzle means are basically the same in construction and operation, except for the number of injecting holes and the stroke of the nozzle pipe.

The first nozzle means 20 includes an outer nozzle 21 secured to the casing 12 and oriented toward an inner space **11*a* of the toilet bowl 11 in a slant manner. In the outer nozzle 21, there is provided an inner nozzle 22 having at its front end three holes 23, each of which is oriented in the upward direction. The inner nozzle 22 is set to be extended or retracted through a hole 21*a* formed at a front wall 21*b* of the outer nozzle 21**.

On a rear portion of the inner nozzle 22, there is fixedly mounted a retainer 24 having at its front side a semi-spherical surface. A spring 25 is disposed between the wall **21*b* and the retainer 24 for urging the inner nozzle 22 to its retracted position as shown in FIG. 2. In the rear portion of the inner nozzle 22 is a valve 26 having a body 26*a* and a spring 26*b*** for urging the body 26a in the rearward direction. While the inner nozzle 22 is in its retracted position, the body 26a of the valve 26 is in abutment with a projection 27 formed at a rear wall 21c of the outer nozzle 21. This abutment is adjusted to open the valve 26.

The retainer 24 has at its rear side a plurality of equally pitched projections 24a which are in abutment with the rear wall 21b in such a manner that the plural projections 24a enclose an inlet 21d of the outer nozzle 21. Thus, the inside of the outer nozzle 21 is in fluid communication with the inlet 21d even though the inner nozzle 22 is in its retracted position.

Under the condition shown in FIG. 2, when the water is supplied from the tank 13 to the inlet 21d of the outer nozzle 21, the resultant water flows into the inside of the outer nozzle 21, passes an auxiliary valve 29 having a ball 29a and a box 29b with an aperture 29c for accommodating the ball 29a. After the passing of a little water through the aperture 29c, due to the water under pressure, the aperture 29c is closed by the biased ball 29a. This condition is kept while the water supply to the outer nozzle 21 is continued. In addition, the water supplied to the inlet 21d of the outer nozzle 21 also causes frontward movement of the inner nozzle 22 against the biasing force of the spring 25. As soon as the inner nozzle 22 is moved in the frontward direction, the valve 26 is closed.

Thereafter, when the retainer 24 is brought into engagement with an inner tapered wall 21e which is formed at a rear side of the auxiliary valve 29, the inner nozzle 22 is brought into its fully extended position as shown in FIG. 3 and the valve 26 is opened, thereby beginning the injection of water to the anus of the user on the seat for the washing thereof.

After the passing of a time, when the water supply to the inlet 27 of the outer nozzle 21 is interrupted, the inner nozzle 22 is returned to its retracted position by the biasing force of the spring 25. In the course of the rearward movement of the inner nozzle 22 from the fully extended position (FIG. 3) to the retracted position (FIG. 2), the retainer 24 moves away from the tapered wall 21e, thereby generating a negative pressure in the inside of the outer nozzle 21. This causes the drop of the ball 29b of the auxiliary valve 29, resulting in the introduction of air into the inside of the outer nozzle 21. Since air can enter the outer nozzle 21, the remaining water in the inside of the outer nozzle 21 can drain into the inner space of the toilet bowl 11 through the hole 21a.

As soon as the outer nozzle 21 is returned to its retracted position, the body 26a of the valve 26 is brought into abutment with the inlet 21d, thereby opening the valve 26. Air is then introduced into the inner nozzle 22 so that the remaining water therein can drain to the inner space of the toilet bowl 11 through the holes 23 and the hole 21a.

Figure 4:
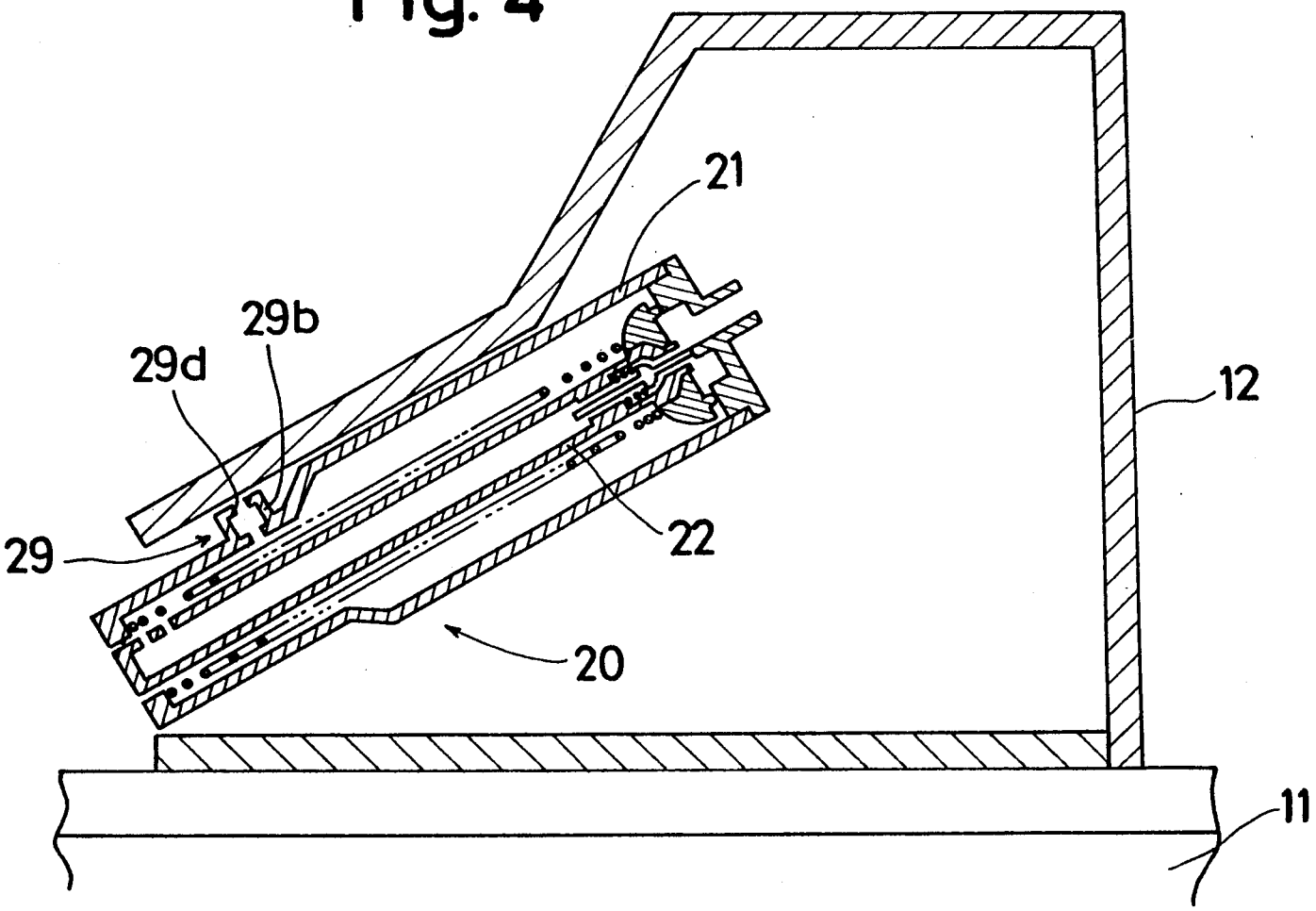
FIG. 4 is a cross-sectional view of a modification of a nozzle which is out of use, and a neighborhood thereof.
Figure 5:
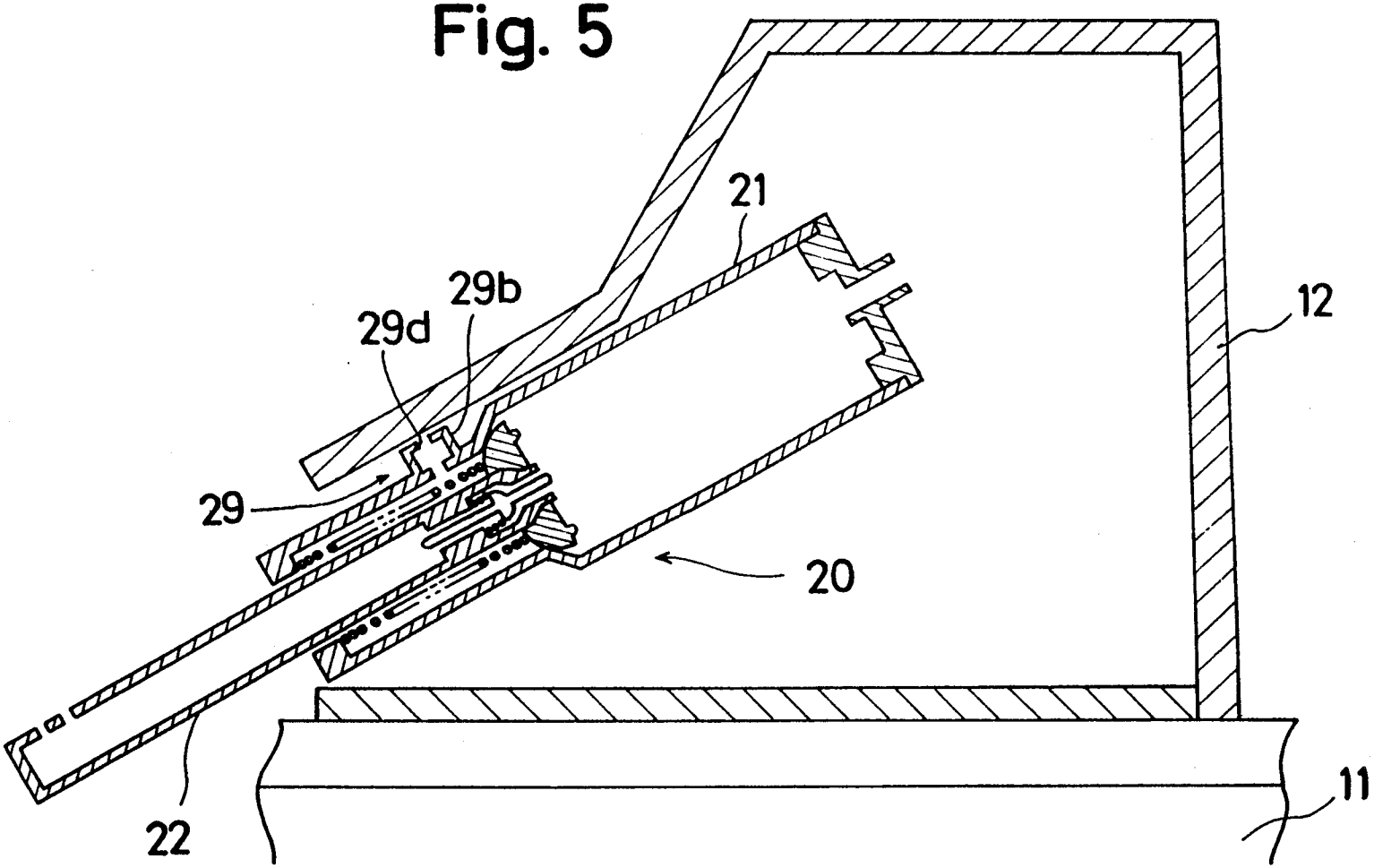
FIG. 5 is a cross-sectional view of a modification of a nozzle which is in use, and a neighborhood thereof.

Instead of the valve 29, an orifice 29d formed in the box 29b can be used, as shown in FIGS. 4 and 5. This is provided in a second embodiment of a sanitary device according to the present invention which is shown in FIGS. 4 and 5 and will not be detailed, due to the fact that the remaining structure of the second embodiment is similar to that of the foregoing embodiment.

While the invention has been particularly shown and described with reference to preferred embodiments thereof, it will be understood by those in the art that the foregoing and other changes may be made therein without departing from the spirit and the scope of the invention.

What is claimed is:

1. A sanitary device comprising:

a toilet bowl having therein an inner space and a rear portion;

a casing mounted on the rear portion of the toilet bowl:

an outer nozzle having at front, intermediate and rear portions thereof, an opening, a tapered wall and an inlet, respectively, the outer nozzle being secured to the casing in such a manner that the outer nozzle is oriented toward the inner space of the toilet bowl;

water supply means for supplying an amount of water continuously to the inlet of the outer nozzle;

an auxiliary valve provided at a frontward portion of the tapered wall of the outer nozzle for interrupting the fluid communication between the atmosphere and the inside of the outer nozzle;

an inner nozzle having holes to be aimed at a body part and disposed in the outer nozzle in such a manner tat when the inner nozzle is in a retracted position, fluid communication between the inlet and the inside of the outer nozzle is established, and when the inner nozzle extends from the opening of the outer nozzle with a retainer mounted of the rear portion of the inner nozzle in engagement with the tapered wall, the inner nozzle is at an extended position;

a spring for urging the inner nozzle in the direction of the retracted position; and a valve disposed in a rear portion of the inner nozzle so as to be opened only when the inner nozzle is in one of the retracted and extended positions.

2. A sanitary device according to claim 1, wherein the auxiliary valve includes a box formed integrally with the outer nozzle and having at a top portion thereof an aperture and a ball accommodated within the box.

3. A sanitary device according to claim 1, wherein the auxiliary valve includes a box formed integrally with the outer nozzle and having an orifice at a top portion thereof.

* * * * *